US011739639B2

(12) United States Patent
Wang et al.

(10) Patent No.: US 11,739,639 B2
(45) Date of Patent: Aug. 29, 2023

(54) COMPOSITE SUPPORT STRUCTURE, CONSTRUCTION SYSTEM, AND METHOD

(71) Applicants: SHANDONG JIANZHU UNIVERSITY, Shandong (CN); ENGINEERING APPRAISAL AND REINFORCEMENT INSTITUTE CO., LTD, SHANDONG JIANZHU UNIVERSITY, Shandong (CN)

(72) Inventors: Jun Wang, Jinan (CN); Xiang Gao, Jinan (CN); Xisen Fan, Jinan (CN); Guohui Liu, Jinan (CN); Jianyong Han, Jinan (CN); Shengzhi Wu, Jinan (CN); Hougang Ding, Jinan (CN)

(73) Assignees: SHANDONG JIANZHU UNIVERSITY, Jinan (CN); ENGINEERING APPRAISAL AND REINFORCEMENT INSTITUTE CO., LTD. SHANDONG JIANZHU UNIVERSITY, Jinan (CN)

( * ) Notice: Subject to any disclaimer, the term of this patent is extended or adjusted under 35 U.S.C. 154(b) by 17 days.

(21) Appl. No.: 17/634,065

(22) PCT Filed: Sep. 15, 2020

(86) PCT No.: PCT/CN2020/115403

§ 371 (c)(1),
(2) Date: Feb. 9, 2022

(87) PCT Pub. No.: WO2021/203625

PCT Pub. Date: Oct. 14, 2021

(65) Prior Publication Data

US 2022/0364469 A1 Nov. 17, 2022

(30) Foreign Application Priority Data

Apr. 9, 2020 (CN) ..... 202010274746.7

(51) Int. Cl.
*E21D 11/10* (2006.01)
*E21D 11/12* (2006.01)
(Continued)

(52) U.S. Cl.
CPC ..... *E21D 11/105* (2013.01); *E21D 11/12* (2013.01); *E21D 11/18* (2013.01); *E21D 11/40* (2013.01); *E21D 20/003* (2013.01); *E21D 23/00* (2013.01)

(58) Field of Classification Search
CPC ..... E21D 11/105; E21D 11/12; E21D 11/18; E21D 11/40; E21D 20/003; E21D 23/00; E21D 11/00; E21D 11/14; E21D 11/083
See application file for complete search history.

(56) References Cited

U.S. PATENT DOCUMENTS 551,042 A * 12/1895 McDonald ..... E21D 11/10 299/61
732,881 A * 7/1903 Muehle ..... E04G 11/22 249/181

(Continued)

FOREIGN PATENT DOCUMENTS

CN 1837578 A 9/2006
CN 1884785 A 12/2006

(Continued)

OTHER PUBLICATIONS

Dec. 30, 2020 Search Report issued in International Patent Application No. PCT/CN2020/115403.

(Continued)

*Primary Examiner* — Edwin J Toledo-Duran
(74) *Attorney, Agent, or Firm* — Oliff PLC

(57) ABSTRACT

A composite support structure, a construction system, and a method, the composite support structure includes a plurality of arc plate rings that are longitudinally arranged along a (Continued)

roadway. A concrete fill steel tube support is arranged on an inner side or an outer side of each arc plate ring. The arc plate ring is formed by splicing a plurality of arc plates. Each concrete fill steel tube support is formed by splicing a plurality of steel pipe sections. The arc plate rings and the concrete fill steel tube supports are capable of jointly supporting walls of the roadway. The support structure has high bearing capability, high construction efficiency of a construction system, and low labor intensity.

6 Claims, 7 Drawing Sheets

(51) Int. Cl.

| | |
|---|---|
| ***E21D 11/18*** | (2006.01) |
| ***E21D 11/40*** | (2006.01) |
| ***E21D 20/00*** | (2006.01) |
| ***E21D 23/00*** | (2006.01) |

(56) References Cited

U.S. PATENT DOCUMENTS 1,382,668 A * 6/1921 O'Rourke ..... E21D 11/12 405/148
1,999,419 A * 4/1935 Mercier ..... E21D 9/12 193/31 R
2,096,850 A * 10/1937 Forsberg ..... E21D 11/15 249/11
2,119,648 A * 6/1938 Piper ..... E21D 11/105 198/642
2,841,303 A * 7/1958 Washabaugh ..... E21D 11/40 405/138
2,870,518 A * 1/1959 Bossner ..... E21D 11/102 425/468
3,074,237 A * 1/1963 Lilly ..... E21D 5/12 405/133
3,075,359 A * 1/1963 Muirhead ..... E21D 11/40 405/148
3,138,933 A * 6/1964 Fisher ..... E21D 19/00 405/142
3,197,179 A * 7/1965 Arnes ..... E21D 15/24 248/354.3
RE26,132 E * 1/1967 Cerutti ..... E21D 11/40 405/138
3,355,215 A * 11/1967 Wallers ..... E21D 9/111 299/71
3,498,675 A * 3/1970 Kampf-Emden ..... E21D 9/12 299/75
3,547,493 A * 12/1970 Starkle ..... E21D 11/10 405/150.1
3,678,694 A * 7/1972 Haspert ..... E21D 11/40 405/152
3,711,159 A * 1/1973 Mazzotti ..... E21D 9/08 299/33
3,768,267 A * 10/1973 Chlumecky ..... E21D 11/05 405/152
3,812,679 A * 5/1974 Ruemmele ..... E21D 11/08 405/152
3,866,426 A * 2/1975 Lobbe ..... E21D 9/0692 405/145
3,885,397 A * 5/1975 Fujimori ..... E21D 11/40 405/288
3,892,100 A * 7/1975 Jamison ..... E21D 20/003 405/291
3,903,707 A * 9/1975 Foik ..... E21D 19/04 405/142
3,970,200 A * 7/1976 Goetjen ..... E21D 11/40 405/148
4,038,829 A * 8/1977 Moebus ..... E21D 11/40 405/153
4,207,016 A * 6/1980 Jinno ..... E21D 5/06 405/133
4,260,297 A * 4/1981 Houston ..... E21D 11/40 405/303
4,302,133 A * 11/1981 Althaler ..... E21D 11/18 405/290
4,320,075 A * 3/1982 Nielson ..... E04G 11/34 264/32
4,505,622 A * 3/1985 Asszonyi ..... E21D 11/102 405/150.1
5,129,761 A * 7/1992 Andersen ..... F16L 1/09 405/150.1
5,645,375 A * 7/1997 Stephens ..... C04B 28/04 405/154.1
5,870,872 A * 2/1999 Hinnen ..... E04F 21/1811 52/749.11
2003/0205411 A1* 11/2003 Pierce ..... E21D 20/003 175/58
2004/0177979 A1* 9/2004 Rubie ..... E21D 11/152 173/39
2006/0158017 A1* 7/2006 McKenzie ..... E21D 19/02 299/1.7
2006/0174549 A1* 8/2006 Dagher ..... E02D 29/05 52/86
2008/0279627 A1* 11/2008 Junker ..... E21D 11/152 404/83
2014/0050532 A1* 2/2014 Burgess ..... E21D 11/40 405/150.1
2015/0050088 A1* 2/2015 Wels ..... E21C 27/24 299/33
2015/0086272 A1* 3/2015 Li ..... E21D 23/0427 405/291
2018/0073261 A1* 3/2018 Simonson ..... E04G 21/1866
2020/0190982 A1* 6/2020 McKenzie ..... E21C 27/02
2021/0108515 A1* 4/2021 Mu ..... E21D 11/102
2021/0324685 A1* 10/2021 Rudolph ..... E21B 7/208
2021/0388724 A1* 12/2021 Meng ..... E21D 15/44
2022/0364469 A1* 11/2022 Wang ..... E21D 11/083

FOREIGN PATENT DOCUMENTS

CN 103195457 A 7/2013
CN 103266904 A 8/2013
CN 103362527 A 10/2013
CN 103527201 A 1/2014
CN 203403900 U 1/2014
CN 103993561 A 8/2014
CN 104564050 A 4/2015
CN 204571997 U 8/2015
CN 105350991 A 2/2016
CN 205206838 U 5/2016
CN 205503146 U 8/2016
CN 205936667 U 2/2017
CN 107701208 A 2/2018
CN 107725068 A 2/2018
CN 207315420 U 5/2018
CN 108119166 A 6/2018
CN 207761671 U 8/2018
CN 109139074 A 1/2019
CN 208330397 U 1/2019
CN 208950613 U 6/2019
CN 110145347 A 8/2019
CN 110410105 A 11/2019
CN 110566252 A 12/2019
CN 210033424 U 2/2020
CN 111425216 A 7/2020
KR 20120048152 A 5/2012
WO 2010078033 A2 7/2010

OTHER PUBLICATIONS

Dec. 30, 2020 Written Opinion of the International Searching Authority issued in International Patent Application No. PCT/CN2020/115403.
Feb. 2, 2021 First Office Action issued in Chinese Patent Application No. 202010274746.7.

(56) References Cited

OTHER PUBLICATIONS

Miao Qingfu et al. "Application research of composite support technology based on concrete-filled steel tube support in roadway of fault fractured zone," China Coal. vol. 45 No. 5. May 22, 2019. pp. 95-101.

Liu Zhaoming et al. "High yield and high efficiency model of small and medium coalmine," Tianjin Science and Technology. Dec. 31, 2012. pp. 16 and 17.

* cited by examiner

COMPOSITE SUPPORT STRUCTURE, CONSTRUCTION SYSTEM, AND METHOD

TECHNICAL FIELD

The present invention relates to the field of underground engineering support technologies, and specifically, to a composite support structure, a construction system, and a method.

BACKGROUND

The description in this section merely provides background information related to the present invention and does not necessarily constitute the prior art.

At present, coal is still the dominant energy supply method in China. Over 80% coal mines are mined by underground mining, and the mining depth increases at a rate of 8-12 m/a. At present, nearly 50 mines have been mined at a depth of one thousand meters or more, and more than half of coal resources in China are stored at a burial depth of one thousand meters or more. As the depth of coal mining continues to increase, more mines will be mined at a depth of one thousand meters or more. After mining at the depth of one thousand meters or more, the pressure on the surrounding rock of a roadway continues to increase, and the stability of an existing support structure keeps decreasing. Because the bearing capability of a conventional support structure (such as an I-steel, a U-shaped steel, anchor mesh shotcrete, or anchor grouting) is insufficient, large deformations are easily generated under the action of deep high stress, and long-term stability of a deep roadway cannot be ensured. The roadway needs to be repaired frequently, leading to increased support costs and the need to research and develop a support structure with higher support force. In addition, a tunneling process and a support process are separate in a conventional support form. A fully-mechanized roadheader is used for tunneling, an anchor net is used for a temporary support, and a structural form such as a U-shaped steel bracket is used for a permanent support. An anchor-net support lags behind the fully-mechanized roadheader, and an empty roof distance is large, which easily causes roof collapse, leading to relatively serious engineering accidents. The permanent support generally requires human labor, which has a low mechanization level, a slow construction speed, and high labor intensity of workers. As a result, the formation speed of the roadway is slow, and the support costs increase. It is necessary to research and develop a fast anchor-net support technology to shorten the empty roof distance and moreover to improve a support mechanization level and reduce the labor intensity of workers.

SUMMARY

The objectives of the present invention are to overcome the shortcomings of the prior art, and provide a composite support structure that has high bearing capability and adequate support and is suitable for supporting a complex roadway with deep high stress.

To achieve the foregoing objectives, the present invention uses the following technical solutions:

According to a first aspect, the embodiments of the present invention provide a composite support structure, including a plurality of arc plate rings that are longitudinally arranged along a roadway, where a concrete fill steel tube support is arranged on an inner side or an outer side of each arc plate ring, and the arc plate ring is formed by splicing a plurality of arc plates; and the concrete fill steel tube support is formed by splicing a plurality of steel pipe sections, and the arc plate rings and the concrete fill steel tube supports are capable of jointly supporting walls of the roadway.

According to a second aspect, the embodiments of the present invention provide a construction system for a composite support structure, the system including:

a tunneling machine, configured to excavate a roadway;

an anchor rod construction apparatus, including a temporary support, where the temporary support is connected to a first walking mechanism, the first walking mechanism is capable of driving the temporary support to support a top side of the roadway and move forward in a longitudinal direction of the roadway, the temporary support is provided with an arch beam, the arch beam is connected to a moving mechanism, the moving mechanism is connected to an anchor rod drill, and the moving mechanism is capable of driving the anchor rod drill to move along the arch beam, to perform an anchor rod construction on the roadway;

an arc plate construction apparatus, including a load bearing platform, where the load bearing platform is connected to a second walking mechanism, the second walking mechanism is capable of driving the load bearing platform to move forward in the longitudinal direction of the roadway, a front end of the load bearing platform is connected to a rotating member by a retractable member, the rotating member is connected to a fixing member by a retractable mounting arm, the fixing member is capable of being fixed to an arc plate, and the rotating member is capable of driving the mounting arm to rotate, to mount the are plate; and a steel pipe construction apparatus, configured to construct the concrete fill steel tube support.

According to a third aspect, the embodiments of the present invention provide a working method of the construction system for a composite support structure, the method including an anchor rod construction process, an arc plate construction process, and a steel pipe construction process that are synchronously performed, where in a method of the anchor rod construction process, the tunneling machine and the anchor rod construction apparatus move forward synchronously, the tunneling machine excavates a heading rock layer to form a space of the roadway, the tunneling machine tunnels by a set distance and stops, an anchor net is placed on an inner wall of the roadway, the first walking mechanism lifts the temporary support to support the top side of the roadway, the moving mechanism drives the anchor rod drill to move along the arch beam, and an anchor rod is constructed to complete an anchor-net support;

in a method of the arc plate construction process, the fixing member is fixed to the arc plate, the retractable member extends and retracts, the rotating member drives the retractable mounting arm to rotate to a set position, the retractable mounting arm extends to mount the are plate in position, mounting of a plurality of arc plates is completed from bottom to top by using a same method to form arc plate rings, the second walking mechanism works, and the arc plate construction apparatus moves forward to complete mounting of a plurality of arc plate rings in sequence;

the steel pipe construction apparatus is located behind or in front of the arc plate construction apparatus, and the concrete fill steel tube support is mounted after the arc plate ring is mounted, or the arc plate ring is mounted after the concrete fill steel tube support is mounted; and a grout is injected between the arc plate rings and the inner wall of the roadway after the are plate ring and the concrete fill steel tube support are mounted.

Beneficial Effects of the Present Invention are as Follows:

1. The composite support structure of the present invention uses the concrete fill steel tube supports, the arc plate rings, and the anchor rod to jointly support a roadway. Compared with a conventional support using only the anchor rod or a steel shed, the composite support structure has significantly enhanced support strength and is suitable for supporting a complex roadway with deep high stress.

2. The construction system and construction method of the present invention have the anchor rod construction apparatus, the arc plate construction apparatus, and the steel pipe construction apparatus that can move forward along a roadway, and each construction apparatus can work automatically, to implement the automatic construction of the anchor rod, the arc plate, and steel pipes, thereby reducing labor intensity and improving construction efficiency. The anchor rod construction apparatus, the arc plate construction apparatus, and the steel pipe construction apparatus can be arranged in the roadway in sequence, and processes are performed synchronously and in parallel, thereby implementing joint operations and greatly shortening a construction time.

BRIEF DESCRIPTION OF THE DRAWINGS

The accompanying drawings that constitute a part of this application are used to provide a further understanding of this application. Exemplary embodiments of this application and descriptions of the embodiments are used to explain this application, and do not constitute a limitation to this application.

Figure 1:
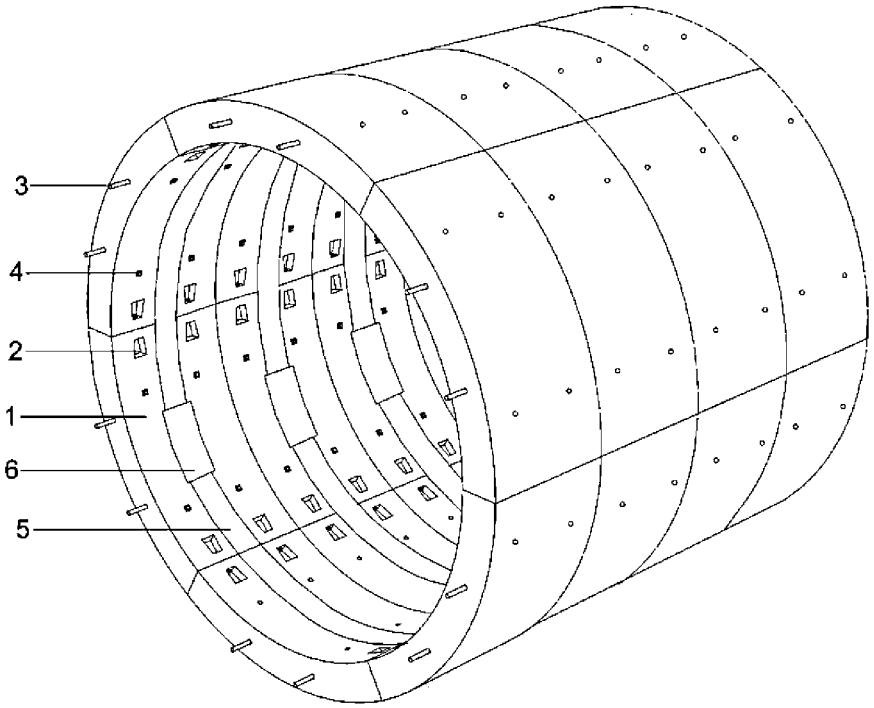
FIG. 1 is a schematic diagram of a support structure according to Embodiment 1 of the present invention.

1. arc plate ring, 2. circumferential bolt, 3. are plate joint bar, 4. grouting hole, 5. concrete fill steel tube support, 6. connecting sleeve, 7. tunneling machine, 8. first support portion, 8-1. longitudinal beam, 8-2. crossbeam, 9. second support portion, 10. first hydraulic cylinder, 11. second hydraulic cylinder, 12. third hydraulic cylinder, 13. connecting frame, 14. arch frame, 15. anchor rod drill, 16. first rack, 17. first gear, 18. first motor, 19. connecting plate, 20. baffle, 21. load bearing platform, 22. fourth hydraulic cylinder, 23. connecting member, 24. bearing beam, 24-1. channel steel, 24-2. end portion steel plate, 25. fixed gripper, 26. movable gripper, 27. fifth hydraulic cylinder, 28. sixth hydraulic cylinder, 29. sliding plate, 30. gear shaft 31. telescopic oil cylinder, 32. rotating oil cylinder, 33. reinforcing column, 34. reinforcing groove, 35. bearing arm, 36. head, 37. retractable mounting arm, 38. fixing member, 39. retractable truss, 40. fixed seat, 41. winch, 42. roller, 43. pull rope, 44. control platform, 45. hydraulic station, 46. arc plate, 47. anchor net, 48. anchor rod, 49. steel pipe section, 50. concrete pump, 51. steel pipe construction apparatus, 52. backfill part, and 53. arc plate construction apparatus.

DETAILED DESCRIPTION

It should be noted that, the following detailed descriptions are exemplary, and are intended to provide a further description to this application. Unless otherwise defined, all technical and scientific terms used herein have the same meanings as commonly understood by a person of ordinary skill in the field to which this application belongs.

It should be noted that terms used herein are only for the purpose of describing specific implementations and are not intended to limit the exemplary implementations of this application. As used herein, the singular form is intended to include the plural form, unless the context clearly indicates otherwise. In addition, it should further be understood that terms "comprise" and/or "include" used in this specification indicate that there are features, steps, operations, devices, components, and/or combinations thereof.

For convenience of description, the words "above", "below", "left", and "right" only indicate directions consistent with those of the accompanying drawings, are not intended to limit the structure, and are used only for ease and brevity of illustration and description, rather than indicating or implying that the mentioned device or element needs to have a particular orientation or needs to be constructed and operated in a particular orientation. Therefore, such terms should not be construed as a limitation on the present invention.

As described in the BACKGROUND, an existing roadway support structure has insufficient support strength and is not suitable for a deep roadway. In addition, a tunneling process and a support process are separate, resulting in a long construction time of a roadway. In view of the above-mentioned problems, this application provides a composite support structure.

In Example 1 of a typical implementation of this application, as shown in FIG. 1, a composite support structure includes a plurality of are plate rings that can be longitudinally arranged along a roadway. Each arc plate ring 1 is formed by splicing a plurality of arc plates. In a circumferential direction of the arc plate ring, the plurality of are plate rings are fixedly connected by circumferential bolts 2. In a longitudinal direction of the roadway, adjacent are plate rings are fixed by an arc plate joint bar 3. The arc plates are provided with grouting holes 4 for subsequent grouting behind a wall.

A concrete fill steel tube support is arranged on an inner side of the arc plate ring. The concrete fill steel tube support is embedded in a groove in the inner side of the arc plate ring. The concrete fill steel tube support 5 is formed by splicing a plurality of steel pipe sections. Adjacent steel pipe sections are spliced by a connecting sleeve 6. The concrete fill steel tube support is in contact with the inner side of the arc plate ring, so that the load bearing capability of the arc plate ring can be enhanced, thereby improving the load bearing capability of the whole support structure.

Figure 2:
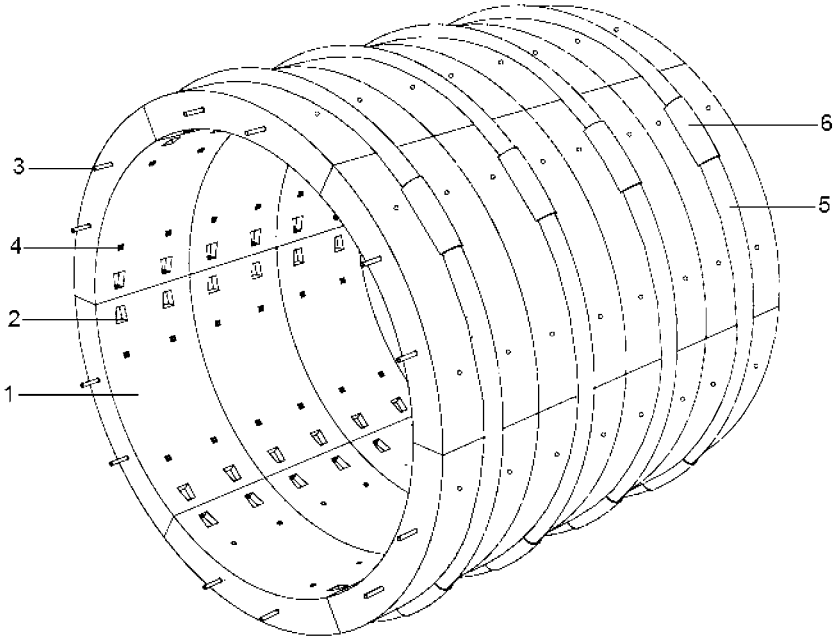
FIG. 2 is a schematic diagram of a support structure according to Embodiment 1 of the present invention.

In another embodiment, as shown in FIG. 2, concrete fill steel tube support is arranged on an outer side of the arc plate ring. In this way, the bearing capability of the whole support structure can be enhanced, a stable space is provided for the construction of the arc plates, and a time is reserved for the unstressed maintenance of a poured concrete layer between the are plates and an inner wall of the roadway.

Embodiment 2

Figure 3:
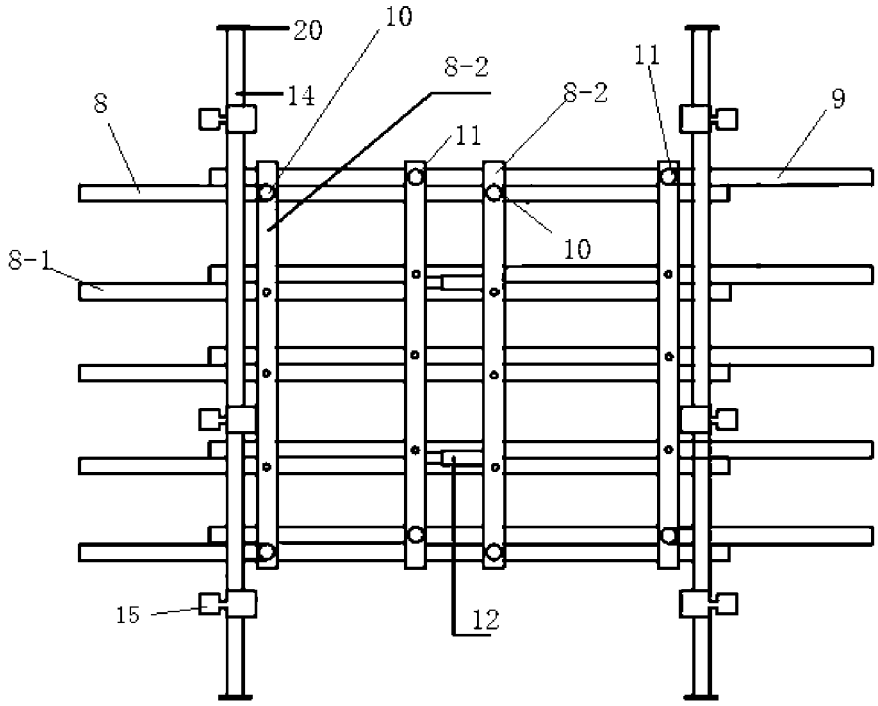
FIG. 3 is a bottom view of an anchor rod construction apparatus according to Embodiment 2 of the present invention.

This embodiment discloses a construction system for the composite support structure according to Embodiment 1. As shown in FIG. 3, the construction system includes a tunneling machine, an anchor rod construction apparatus, an arc plate construction apparatus, and a steel pipe construction apparatus.

During construction of a support structure with concrete fill steel tube support on the inner side of the arc plate ring, the tunneling machine, the anchor rod construction apparatus, the arc plate construction apparatus, and the steel pipe construction apparatus are arranged in the roadway in sequence, and perform construction synchronously. The tunneling machine is configured to tunnel the roadway. The anchor rod construction apparatus is configured to construct an anchor rod. The arc plate construction apparatus constructs the arc plate ring on the part of the roadway with the anchor rod constructed. The steel pipe construction apparatus is configured to construct the concrete fill steel tube support on the inner side of the constructed arc plate ring.

During construction of a support structure with the concrete fill steel tube support on the outer side of the arc plate ring, the steel pipe construction apparatus is located in front of the are plate construction apparatus. The concrete fill steel tube support is constructed first, and then the arc plate ring is constructed on the constructed concrete fill steel tube support to support the concrete fill steel tube support.

The tunneling machine 7 may be an existing tunneling machine that can excavate and cut a heading rock layer, to form a space of the roadway. A specific structure of the tunneling machine is not described in detail herein.

Figure 4:
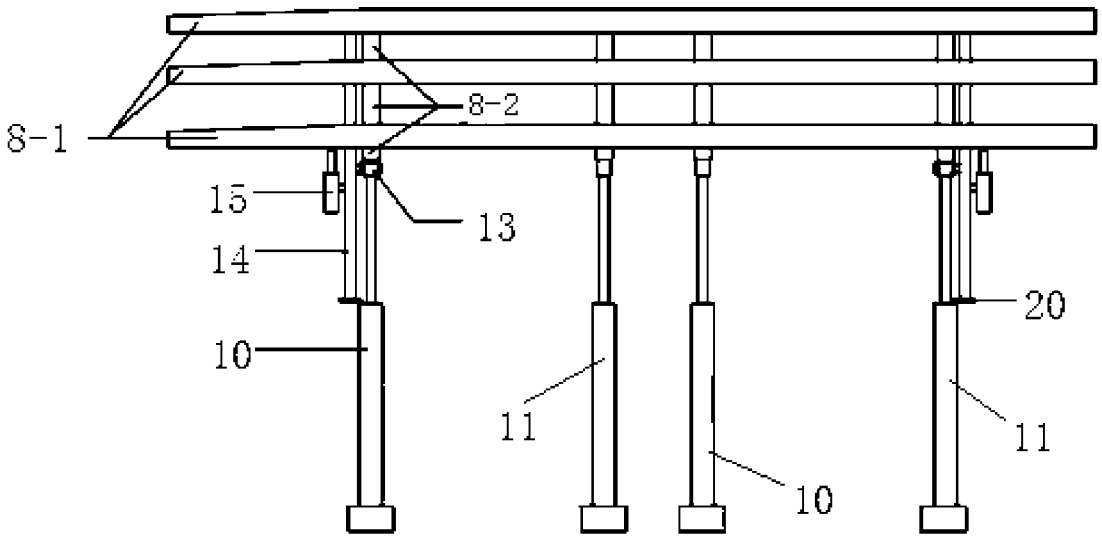
FIG. 4 is a front view of an anchor rod construction apparatus according to Embodiment 2 of the present invention.
Figure 5:
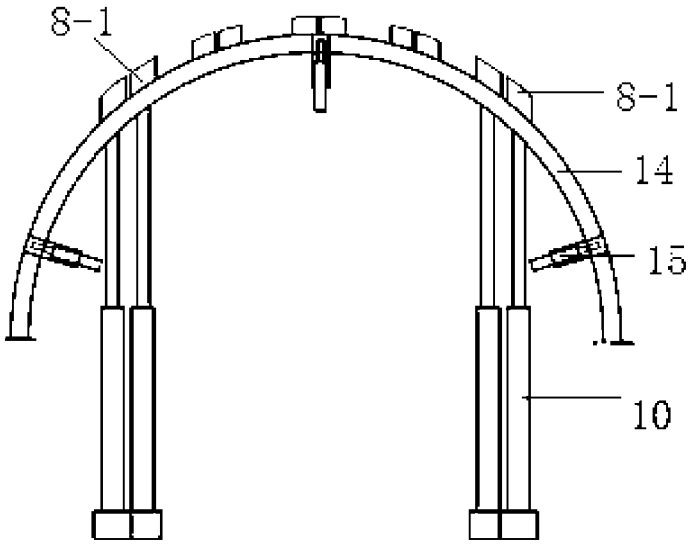
FIG. 5 is a side view of an anchor rod construction apparatus according to Embodiment 2 of the present invention.

As shown in FIG. 3 to FIG. 5, the anchor rod construction apparatus includes a temporary support. The temporary support is connected to a first walking mechanism. The first walking mechanism can drive the temporary support to move vertically, so that the temporary support can tightly abut against a top side of the roadway, and the first walking mechanism can drive the temporary support to move forward in the longitudinal direction of the roadway.

The temporary support includes a first support portion 8 and a second support portion 9. The first support portion and the second support portion have the same structure, including five longitudinal beams 8-1. The longitudinal beams are axially arranged in the longitudinal direction of the roadway. The distribution trajectories of the five longitudinal beams match the shape of the roadway. The five longitudinal beams can fit the top of the roadway. The longitudinal beams of the first support portion and the second support portion are arranged in a staggered manner.

In some other embodiments, six, seven or more longitudinal beams may be disposed. The number of the longitudinal beams may be set according to an actual construction condition of the roadway. The longitudinal beam may be a steel plate, a channel steel, or an I-steel, which may be selected by a person skilled in the art according to an actual requirement.

The five longitudinal beams are all fixed by bolts to a plurality of crossbeams 8-2 that are arranged perpendicular to the longitudinal beams. In this embodiment, two crossbeams are disposed, and the crossbeams of the first support portion and the second support portion are alternately arranged.

The first walking mechanism includes four first hydraulic cylinders 10 fixedly connected to the first support portion, four second hydraulic cylinders 11 fixedly connected to the second support portion, and two third hydraulic cylinders 12 arranged between the two crossbeams close to each other of the first support portion and the second support portion. Each first hydraulic cylinder and each second hydraulic cylinder are arranged vertically, and each third hydraulic cylinder is horizontally arranged.

Two ends of the two crossbeams of the first support portion are both fixedly connected to the first hydraulic cylinder, and two ends of the two crossbeams of the second support portion are both fixedly connected to the second hydraulic cylinder.

Two ends of the third hydraulic cylinder are respectively fixedly connected to the two crossbeams of the first support portion and the second support portion.

Piston rods of the first hydraulic cylinder and the second hydraulic cylinder extend to allow the longitudinal beam to tightly abut against the top side of the roadway. In this case, the piston rod of the first hydraulic cylinder retracts, and the third hydraulic cylinder extends to drive the first support portion to move forward. After the first support portion moves forward to a set position, the piston rod of the first hydraulic cylinder extends again, to make the first hydraulic cylinder tightly abut against the longitudinal beam again. In this case, the piston rod of the second hydraulic cylinder retracts, and the third hydraulic cylinder retracts, to drive the second support portion to move forward. After the second support portion moves forward to a set position, the piston rod of the second hydraulic cylinder extends and tightly abuts against the second support portion again, to complete one-step walking. A same method may be used to make the first walking mechanism complete multi-step walking.

The crossbeams connected to the first hydraulic cylinder and the second hydraulic cylinder of the first support portion and the second support portion are all connected to an arch frame 14 by a connecting frame 13. The arch frame and the connecting frame are fixed by welding. The connecting frame is fixed to the crossbeams. The arch frame uses an arc-shaped I-steel. The shape of the I-steel matches the shape of the roadway.

In some other embodiments, the arch frame may be a channel steel, a square steel, or the like.

The arch frame is connected to a moving mechanism. The moving mechanism is connected to an anchor rod drill 15. The moving mechanism can drive the anchor rod drill to move along the arch frame.

Figure 6:
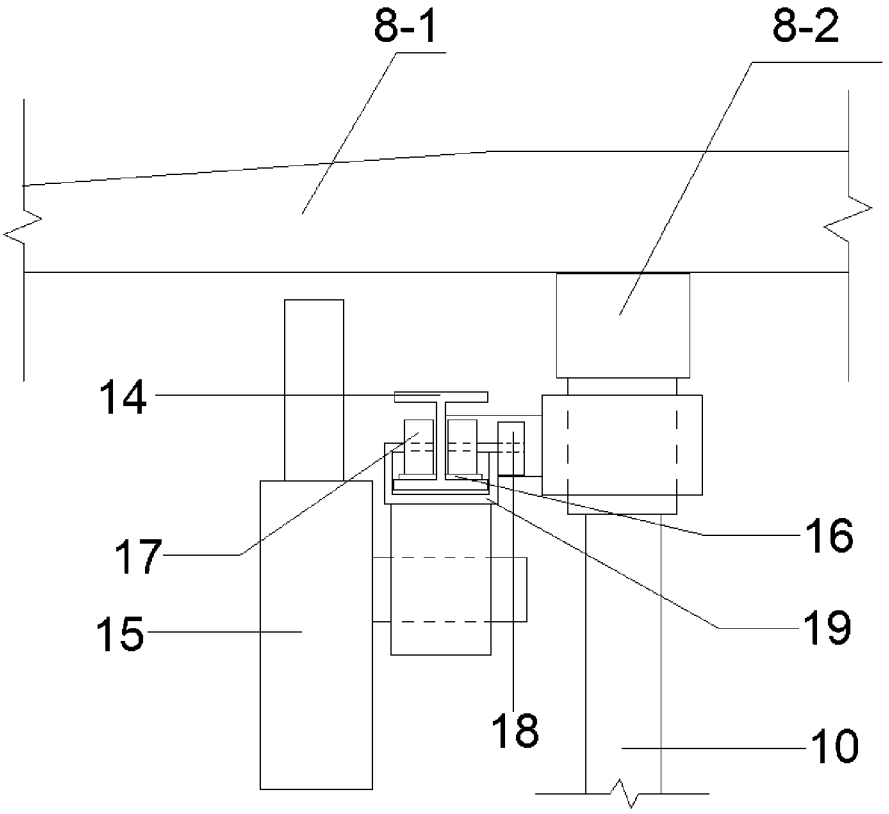
FIG. 6 is a schematic diagram of a moving mechanism according to Embodiment 2 of the present invention.
Figure 7:
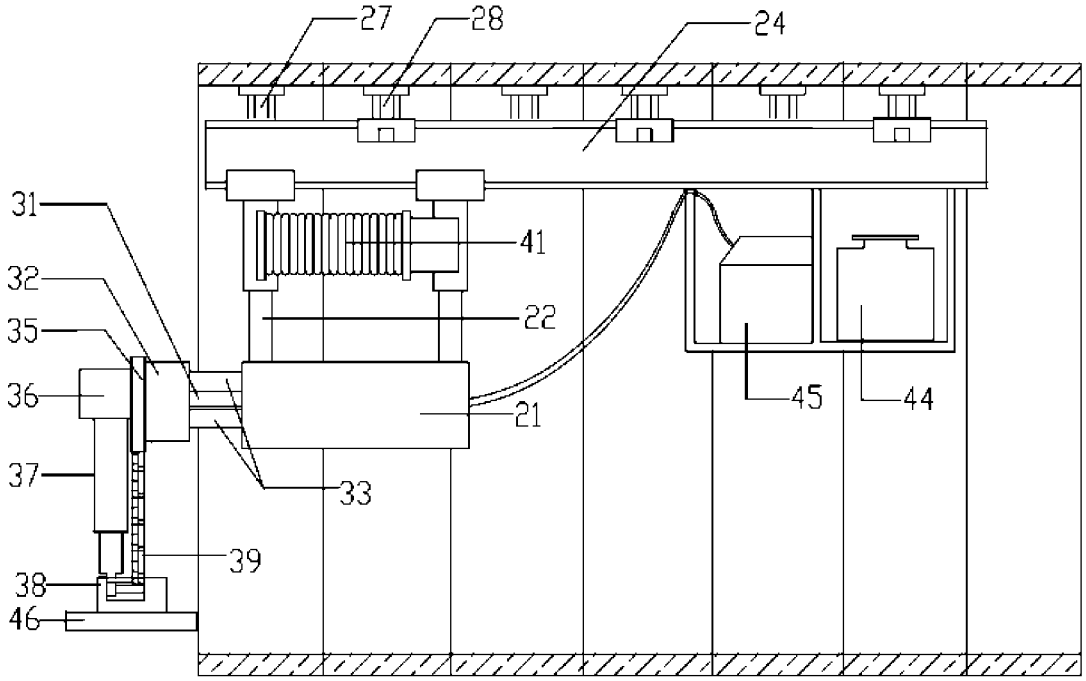
FIG. 7 is a front view of an arc plate construction apparatus according to Embodiment 2 of the present invention.
Figure 8:
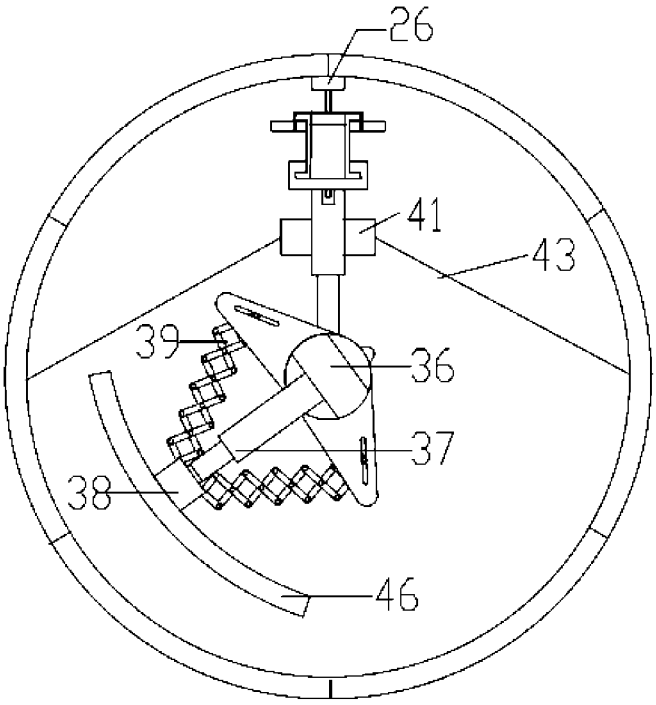
FIG. 8 is a side view of an arc plate construction apparatus according to Embodiment 2 of the present invention.
Figure 9:
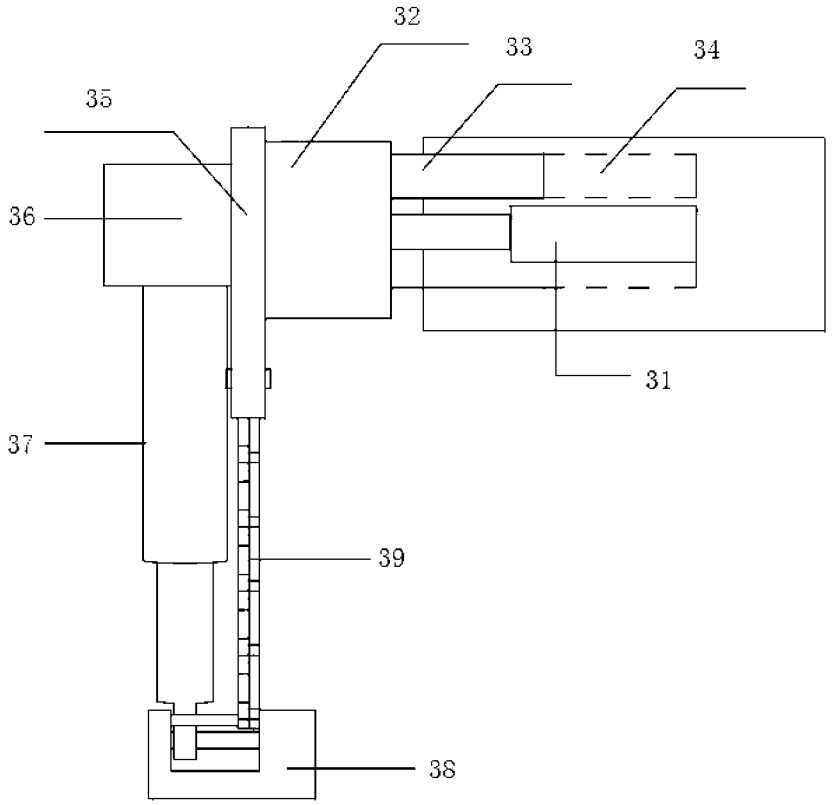
FIG. 9 is a schematic diagram of assembly of a load bearing platform, a rotating member, a retractable member, a bearing arm, and a retractable mounting arm according to Embodiment 2 of the present invention.
Figure 10:
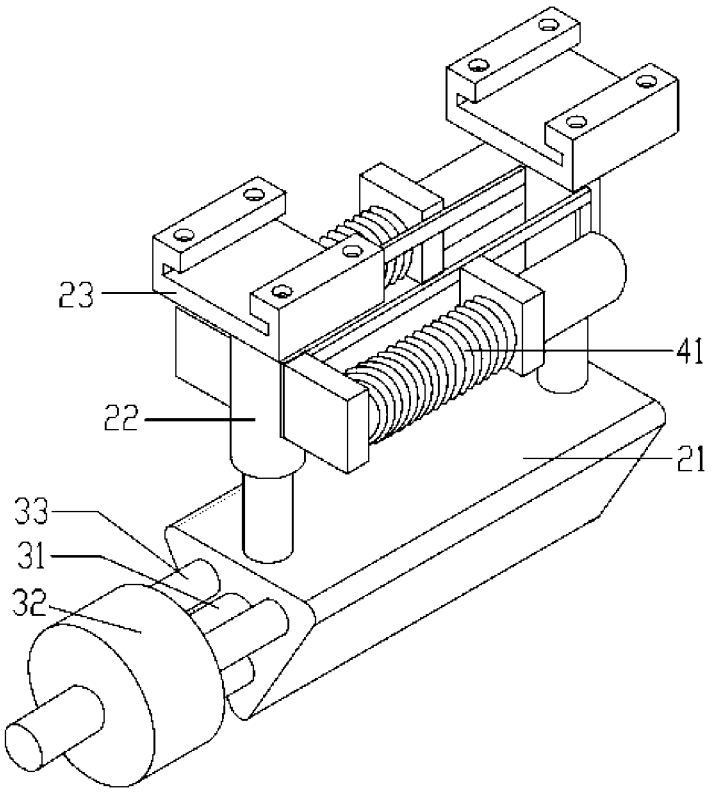
FIG. 10 is a schematic diagram of assembly of a load bearing platform and a fourth hydraulic cylinder according to Embodiment 2 of the present invention.
Figure 11:
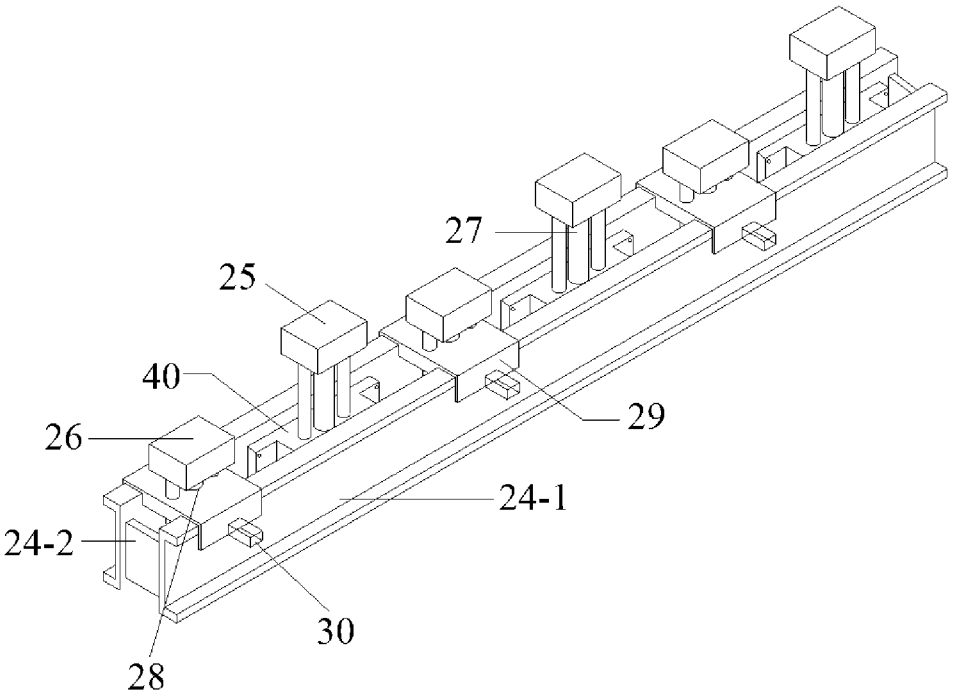
FIG. 11 is a schematic structural diagram of a second walking mechanism according to Embodiment 2 of the present invention.
Figure 12:
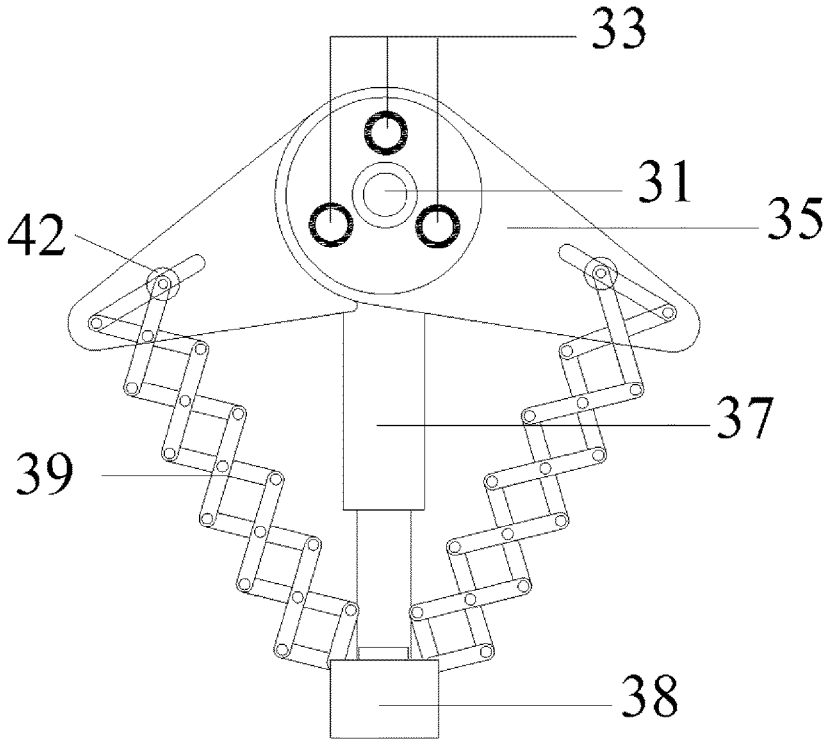
FIG. 12 is a schematic diagram of assembly of a retractable truss and a bearing arm according to Embodiment 2 of the present invention.

As shown in FIG. 6, the moving mechanism includes a first rack 16 fixed on an upper surface of a wing plate below the arch frame. The first rack meshes with two first gears 17. The two first gears are respectively arranged on two sides of a web plate of the arch frame. One of the first gears that is close to the crossbeams is connected to an output shaft of a first motor. A motor housing of the first motor 18 is further fixed to a connecting plate 19. The connecting plate is rotatably connected to the other first gear. By providing the two first gears, the balance of the first motor can be maintained, so that when the first motor drives the first gears to rotate, the first motor can move along the arch frame. The connecting plate is connected to the anchor rod drill. The connecting plate can drive the anchor rod drill to move along an arch plate. The anchor rod drill is configured to construct the anchor rod.

In this embodiment, three anchor rod drills are provided. The moving mechanism shares one rack. In some other embodiments, four, five or more anchor rod drills may be disposed. The number of the anchor rod drills may be selected according to an actual construction condition.

The first motor drives the first gears to rotate. The first gears can move along the first rack. Further, the first motor can move along the arch frame, thereby driving the anchor rod drill to move along the arch frame, so that the anchor rod drill moves to a set position to perform an anchor rod construction.

Two ends of the arch plate are provided with a baffle 20, to prevent the anchor rod drill from falling off the arch frame.

In some other embodiments, the moving mechanism may be a trolley that can move along the arch frame or another movable mechanism. Details are not described herein.

As shown in FIG. 7 to FIG. 12, the are plate construction apparatus includes a load bearing platform 21. The load bearing platform uses a triangular prism structure. In some other embodiments, the load bearing platform uses a rectangular parallelepiped structure, a cylindrical structure, or a structure of another shape.

A top side of the load bearing platform is fixedly connected to piston rods of two fourth hydraulic cylinders 22. Each fourth hydraulic cylinder is vertically arranged. A top end of a cylinder body of the fourth hydraulic cylinder is fixed to a connecting member 23. The fourth hydraulic cylinder can be connected to a second walking mechanism by the connecting member.

The second walking mechanism includes a bearing beam 24. The bearing beam is fixedly connected to the connecting member. The bearing beam includes two channel steels 24-1 arranged in parallel. Opening sides of the two channel steels are arranged opposite to each other. Two ends of the two channel steels are fixed through welding by an end portion steel plate 24-2, and a second rack is fixed on a lower surface of an upper wing edge of each channel steel.

The connecting member 23 uses a connecting block. The connecting block is provided with a T-shaped groove, can be clamped with the bearing beam, and is fixedly connected to the bearing beam by a fastening bolt, to implement a fixed connection between the bearing beam and the fourth hydraulic cylinder.

The bearing beam is alternately provided with three fixed grippers 25 and three movable grippers 26. It may be understood that four, five, or more fixed grippers and movable grippers may be disposed, as long as a requirement is met.

Each fixed gripper is connected to a first lifting member. The first lifting member uses a fifth hydraulic cylinder 27. The fixed gripper is connected to the piston rod of the fifth hydraulic cylinder. A cylinder body of the fifth hydraulic cylinder 27 is fixedly connected to a fixed seat 40 fixed through welding inside the bearing beam. The fifth hydraulic cylinder can drive the fixed gripper to move vertically.

Each movable gripper is connected to a second lifting member. The second lifting member uses a sixth hydraulic cylinder 28. The movable gripper is fixedly connected to a piston rod of the sixth hydraulic cylinder. A cylinder body of the sixth hydraulic cylinder is fixedly connected to a sliding plate 29. The sliding plate is slidably connected to the two channel steels of the bearing beam.

The fixed gripper and the movable gripper both use an electromagnetic chuck, and can be attracted and fixed to the arc plate after being energized.

The second rack is arranged on the lower surface of the upper wing edge of the channel steel 24-1 in a length direction of the channel steel. The sliding plate is fixed to a gear shaft 30. The gear shaft is rotatably connected to a second gear. The second gear meshes with the second rack. The sliding plate is connected to a pushing member arranged in the bearing beam. The pushing member uses a pushing oil cylinder. A piston rod of the pushing oil cylinder is fixedly connected to the sliding plate. A cylinder body of the pushing oil cylinder is fixedly connected to the bearing beam. The movable gripper 26 is pushed by the pushing oil cylinder in the bearing beam 24 to move forward.

When the second walking mechanism in this embodiment works, the fixed gripper attracts and fixes the arc plate. The movable gripper is de-energized and leaves the arc plate under the action of the sixth hydraulic cylinder. The pushing oil cylinder in the bearing beam pushes the movable gripper to move forward. The sixth hydraulic cylinder drives the movable gripper to move upward. The movable gripper is energized to attract and fix the arc plate. The fixed gripper is de-energized and leaves the arc plate under the action of the fifth hydraulic cylinder. The pushing oil cylinder in the bearing beam retracts and drives the bearing beam to move forward. The fifth hydraulic cylinder drives the fixed gripper to move upward. The fixed gripper is energized to attract and fix the arc plate. A walk is completed. In this way, multi-step walking may be implemented, thereby implementing a longitudinal movement of the load bearing platform along the roadway.

A retractable member is provided inside the load bearing platform. The retractable member uses a telescopic oil cylinder 31. The telescopic oil cylinder is fixed inside the load bearing platform. A piston rod of the telescopic oil cylinder can extend outside a front end of the load bearing platform. The piston rod of the telescopic oil cylinder is fixedly connected to a rotating member. The rotating member uses a rotating oil cylinder 32. The telescopic oil cylinder can drive a linear movement of the rotating oil cylinder.

In some other embodiments, the retractable member may use a linear motor or an electric pushing rod, and the rotating member may be a motor, or the like, which may be arranged by a person skilled in the art according to an actual requirement.

The rotating oil cylinder is further provided with three reinforcing columns 33. The load bearing platform is provided with reinforcing grooves 34 matching the reinforcing columns. Each reinforcing columns can extend into each reinforcing groove to ensure that the telescopic oil cylinder only extends and retracts but does not bear a load.

It may be understood that four, five, or more reinforcing columns may be disposed. The number of the reinforcing columns is selected according to an actual situation.

An output shaft of the rotating oil cylinder is connected to two bearing arms 35 arranged at an angle and a head 36 located on one side of each bearing arm. The rotating oil cylinder can drive the bearing arm and the head to rotate 360°.

The head is fixedly connected to one end of a retractable mounting arm 37, and the other end of the retractable mounting arm is mounted with a fixing member 38. The retractable mounting arm may use a hydraulic cylinder that can implement a telescopic movement or may use a linear motor or an electric pushing rod, as long as a linear movement can be outputted.

The fixing member uses an electromagnetic chuck, and can be attracted and fixed to the arc plate after being energized.

One end of the bearing arm is fixedly connected to the output shaft of the rotating oil cylinder, and a retractable truss 39 is connected between the other end of the bearing arm and the fixing member. The extension and retraction of the retractable mounting arm can change a length of the retractable truss and an angle between the two retractable trusses and the bearing arm. The two retractable trusses form an angle at a connecting end of the fixing member and are arranged symmetrically with respect to the retractable mounting arm. The retractable truss uses a scissor structure and includes a plurality of scissor units connected in sequence. Each scissor unit includes two centrally hinged connecting rods. The two connecting rods of one scissor unit are separately connected to end portions of two connecting rods of adjacent scissor units. One of the two connecting rods of the scissor unit connected to the bearing arm is hinged to the bearing arm, and the end portion of the other connecting rod is provided with a roller 42 that is arranged in a sliding groove provided in the bearing arm. The two connecting rods of the scissor unit connected to the fixing member are hinged to the fixing member.

The retractable truss can assist the retractable mounting arm in bearing to protect the retractable mounting arm.

The fixing member can attract and fix the arc plate. The rotating oil cylinder can drive the retractable mounting arm to rotate. The retractable mounting arm can drive the fixing member to extend and retract, and then a plurality of arc plates are mounted at 360° to be spliced into the arc plate ring.

The cylinder body of the fourth hydraulic cylinder is further provided with a winch 41. A steel wire rope 43 of the winch is fixedly connected to the mounted are plate. When the steel wire rope is tightened, the arc plate construction apparatus can be fixed, and the arc plate can be fastened a second time.

A bottom surface of the bearing beam is fixed to a control platform 44 and a hydraulic station 45 by a frame body. The hydraulic station is connected to the hydraulic cylinders and oil cylinders by oil pipes to provide hydraulic oil to the hydraulic cylinders and the oil cylinders. The control platform is configured to control the work of related hydraulic cylinders, oil cylinders, motors, and electromagnetic chucks. The hydraulic station is configured to provide hydraulic oil to the hydraulic cylinders and the oil cylinders.

The structures of the steel pipe construction apparatus and the arc plate construction apparatus are same. A difference lies in that the shape of the fixing member matches that of steel pipes, and an arc plate structure is used, so that the steel pipes can be attracted and fixed. Details of other structures are not described again herein.

In the embodiments of the present invention, the related motors, hydraulic cylinders, and oil cylinders can all be controlled through the control platform. The anchor rod, the arc plate ring, and the concrete fill steel tube support can be automatically placed in position, so that the labor time of a constructor is greatly reduced and the construction efficiency is improved.

Embodiment 3

Figure 13:
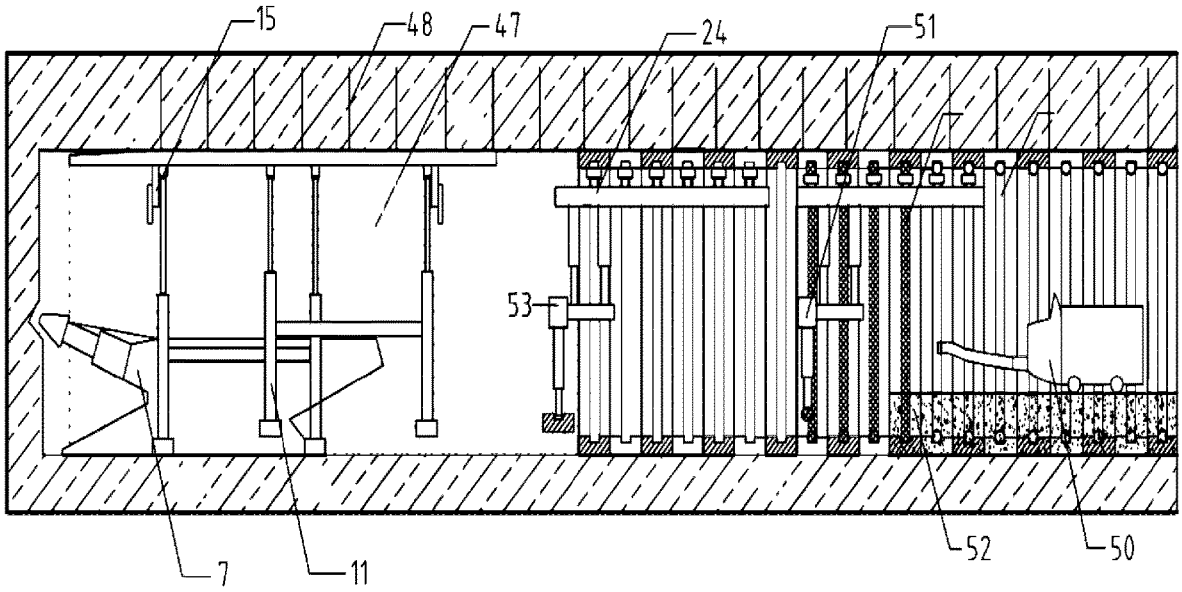
FIG. 13 is a schematic diagram of a construction state of a construction system according to Embodiment 3 of the present invention.

As shown in FIG. 13, this embodiment discloses a working method of the construction system according to Embodiment 2. An example in which the support structure with the concrete fill steel tube support located on the inner side of the arc plate ring is used for description. The working method includes an anchor rod construction process, an are plate construction process, and a steel pipe construction process that are synchronously performed.

In a method of the anchor rod construction process, the tunneling machine 7 tunnels the roadway to excavate a space of the roadway. The anchor rod construction apparatus moves synchronously with the tunneling machine under the driving of the first walking mechanism. After the roadway is excavated by the tunneling machine, the tunneling machine stops working. The first hydraulic cylinder and the second hydraulic cylinder drive the first support portion and the second support portion to leave the top side of the roadway. A constructor erects an anchor net 47 on the inner wall of the roadway. An existing anchor net construction method may be used to construct the anchor net. Details are not described again herein. After the anchor net is erected, the first hydraulic cylinder and the second hydraulic cylinder push the longitudinal beams of the first support portion and the second support portion into the top side of the roadway to act as the temporary support. Under the action of the moving mechanism, the anchor rod drill moves along the arch frame to the set position, and the anchor rod 48 is constructed.

A same method is used. The tunneling machine keeps excavating, and at the same time the constructor erects the anchor net and uses the anchor rod construction apparatus to construct the anchor rod. After the tunneling machine and the anchor rod construction apparatus move forward by a set distance, the constructor starts to use a conventional manual hoisting method at the entrance of the roadway to longitudinally mount the first twelve arc plate rings and the first six concrete fill steel tube supports along the roadway. Each concrete fill steel tube support is arranged on the inner side of each arc plate ring.

The arc plate construction apparatus and the steel pipe construction apparatus are mounted on the constructed arc plate. The arc plate construction apparatus is located in front of the steel pipe construction apparatus. In this case, the arc plate construction apparatus and the steel pipe construction apparatus may move forward synchronously with the tunneling machine and the anchor rod construction apparatus. The arc plate construction apparatus erects the arc plate ring in an area with the anchor rod construction completed. The steel pipe construction apparatus erects the concrete fill steel tube support on the inner side of the constructed arc plate ring.

The tunneling machine, the anchor rod construction apparatus, the arc plate construction apparatus, and the steel pipe construction apparatus move forward synchronously until the roadway is excavated to the set distance. The arc plate ring and the concrete fill steel tube support at an end of the roadway is constructed by using a manual hoisting method. So far, the construction of the roadway and its support are completed.

In a working method of the are plate construction apparatus, the fixing member attracts and fixes an arc plate 46. The telescopic oil cylinder drives the rotating oil cylinder to extend. The rotating oil cylinder drives the retractable mounting arm to rotate to align the arc plate with the position of an arch bottom of the roadway. The retractable mounting arm extends to place the arc plate at the arch bottom in position. The fixing member is de-energized and leaves the arc plate placed in position. The arc plates are mounted in sequence at a rib of the roadway, side walls of the roadway, and the top of the roadway by using a same method. The arc plates of the whole arc plate ring are mounted in a bottom-to-top manner. Every time one arc plate is placed in position, the arc plate is fixed to an adjacent arc plate of the arc plate by the circumferential bolt. Every time one arc plate ring is mounted, the arc plate ring is fixed to an adjacent arc plate ring of the arc plate ring by the arc plate joint bar.

A working method of the steel pipe construction apparatus 51 is similar to that of the arc plate construction apparatus. Details are not described herein again. After a plurality of steel pipe sections 49 of the concrete fill steel tube support are mounted, a concrete pump 50 is configured to grout concrete into the steel pipe sections. The fullness of concrete grouting is checked, and supplementary grouting is performed on underfilled steel pipe sections.

After a set number of arc plate rings are mounted, a wet spray machine is used to inject a grout in a space between the outer side of the arc plate rings and the inner wall of the roadway. After grouting of the arc plate rings is completed, a reverse arch bottom part of the roadway is backfilled to form a backfill part 52.

The above-mentioned processes are performed synchronously and in parallel, thereby greatly shortening a construction period and improving construction efficiency.

When there is no mounting task, the fourth hydraulic cylinder may be controlled to retract, and the retractable mounting arm is rotated to an upper side of the roadway to ensure the passage of pedestrians and equipment in the roadway.

During construction of the support structure with the concrete fill steel tube support on the outer side of the arc plate ring, the steel pipe construction apparatus is located in front of the arc plate construction apparatus. The concrete fill steel tube support is constructed first, and then the arc plate ring is constructed on the constructed concrete fill steel tube support. Construction methods of the concrete fill steel tube support and the arc plate ring are the same as the above-mentioned steps. Details are not described again herein.

The specific implementations of the present invention are described above with reference to the accompanying drawings, but are not intended to limit the protection scope of the present invention. A person skilled in the art should understand that various modifications or deformations may be made without creative efforts based on the technical solutions of the present invention, and such modifications or deformations shall fall within the protection scope of the present invention.

What is claimed is:

1. A construction system for a composite support structure, comprising:

a tunneling machine, configured to excavate a roadway;

an anchor rod construction apparatus, comprising a temporary support, wherein the temporary support is connected to a first walking mechanism, the first walking mechanism is capable of driving the temporary support to support a top side of the roadway and move forward in a longitudinal direction of the roadway, the temporary support is provided with an arch beam, the arch beam is connected to a moving mechanism, the moving mechanism is connected to an anchor rod drill, and the moving mechanism is capable of driving the anchor rod drill to move along the arch beam, to perform an anchor rod construction on the roadway;

the temporary support comprises a first support portion and a second support portion, the first walking mechanism comprises a first hydraulic cylinder and a second hydraulic cylinder that are respectively connected to the first support portion and the second support portion, the first hydraulic cylinder and the second hydraulic cylinder are arranged vertically to allow the first support portion and the second support portion to abut against the top side of the roadway, a third hydraulic cylinder is horizontally arranged between the first support portion and the second support portion, the third hydraulic cylinder is configured to drive the first support portion and the second support portion to move forward, and the first support portion and the second support portion are both connected to the arch beam; and the arch beam is provided with a first rack, the first rack meshes with a first gear, the first gear is connected to an output shaft of a first motor, the first motor is capable of driving the first gear to rotate, under a meshing action of the first rack and the first gear, the first motor is movable along the arch beam, and a motor housing of the first motor is connected to the anchor rod drill to drive the anchor rod drill to move;

an arc plate construction apparatus, comprising a load bearing platform, wherein the load bearing platform is connected to a second walking mechanism, the second walking mechanism is capable of driving the load bearing platform to move forward in the longitudinal direction of the roadway, a front end of the load bearing platform is connected to a rotating member by a retractable member, the rotating member is connected to a fixing member by a retractable mounting arm, the fixing member is capable of being fixed to an arc plate, and the rotating member is capable of driving the mounting arm to rotate, to mount the arc plate; and a steel pipe construction apparatus, configured to construct a concrete fill steel tube support, wherein during construction of a support structure with the concrete fill steel tube support on an inner side of the arc plate ring, the tunneling machine, the anchor rod construction apparatus, the arc plate construction apparatus, and the steel pipe construction apparatus are arranged in the roadway in sequence, and perform construction synchronously; and during construction of a support structure with the concrete fill steel tube support on an outside of the arc plate ring, the tunneling machine, the anchor rod construction apparatus, the arc plate construction apparatus, and the steel pipe construction apparatus are arranged in the roadway in sequence, and perform construction synchronously, wherein the second walking mechanism comprises a bearing beam, the bearing beam is provided with a plurality of alternately arranged fixed grippers and movable grippers, the fixed grippers and the movable grippers are capable of being fixedly connected to the arc plate, each fixed gripper is connected to the bearing beam by a first lifting member, each movable gripper is fixedly connected to a sliding plate by a second lifting member, the sliding plate is slidably connected to the bearing beam, the sliding plate is rotatably connected to a second gear, the second gear meshes with a second rack fixed on the bearing beam, the sliding plate is fixedly connected to one end of a pushing member, and the other end of the pushing member is fixedly connected to the bearing beam.

2. The construction system for a composite support structure according to claim 1, wherein the rotating member uses a rotating oil cylinder, an output shaft of the rotating oil cylinder is fixed to two bearing arms arranged at an angle, one end of each bearing arm is fixedly connected to the output shaft of the rotating oil cylinder, the other end of the bearing arm is connected to one end of a retractable truss, and the other end of the retractable truss is connected to the fixing member arranged at an end portion of the retractable mounting arm.

3. The construction system for a composite support structure according to claim 1, wherein the retractable member uses a telescopic oil cylinder, the telescopic oil cylinder is arranged inside the load bearing platform, a piston rod of the telescopic oil cylinder is connected to the rotating member, the rotating member is further provided with a plurality of reinforcing columns, and each reinforcing column extends into a reinforcing groove arranged in the load bearing platform.

4. The construction system for a composite support structure according to claim 1, wherein the load bearing platform is connected to one end of a vertically arranged lifting drive member, the other end of the lifting drive member is provided with a connecting member, and the connecting member is capable of being connected to the second walking mechanism.

5. The construction system for a composite support structure according to claim 4, wherein the lifting drive member is fixed to a winch, and a steel wire rope of the winch is capable of being fixedly connected to the mounted arc plate.

6. A working method of the construction system for a composite support structure using the construction system for a composite support structure according to claim 1, the method comprising an anchor rod construction process, an arc plate construction process, and a steel pipe construction process that are synchronously performed, wherein in a method of the anchor rod construction process, the tunneling machine and an anchor rod construction apparatus move forward synchronously, the tunneling machine excavates a heading rock layer to form a space of the roadway, the tunneling machine tunnels by a set distance and stops, an anchor net is placed on an inner wall of the roadway, the first walking mechanism lifts the temporary support to support the top side of the roadway, the moving mechanism drives the anchor rod drill to move along the arch beam, and an anchor rod is constructed to complete an anchor-net support;

in a method of the arc plate construction process, the fixing member is fixed to the arc plate, the retractable member extends and retracts, the rotating member drives the retractable mounting arm to rotate to a set position, the retractable mounting arm extends to mount the arc plate in position, mounting of a plurality of arc plates is completed from bottom to top by using a same method to form arc plate rings, the second walking mechanism works, and the arc plate construction apparatus moves forward to complete mounting of a plurality of arc plate rings in sequence;

the steel pipe construction apparatus is located behind or in front of the arc plate construction apparatus, and the concrete fill steel tube support is mounted after the arc plate ring is mounted, or the arc plate ring is mounted after the concrete fill steel tube support is mounted; and a grout is injected between the arc plate rings and the inner wall of the roadway after the arc plate ring and the concrete fill steel tube support are mounted.

* * * * *